United States Patent [19]

Andrei-Alexandru et al.

[11] Patent Number: 4,478,004

[45] Date of Patent: Oct. 23, 1984

[54] WINDOW LIFTER AND DOOR LOCKING DEVICE

[75] Inventors: Marcel Andrei-Alexandru; Hans Prohaska, both of Bietigheim-Bissingen, Fed. Rep. of Germany

[73] Assignee: ITT Industries, Inc., New York, N.Y.

[21] Appl. No.: 353,225

[22] Filed: Mar. 1, 1982

[30] Foreign Application Priority Data

Mar. 25, 1982 [DE] Fed. Rep. of Germany ..... 3111633

[51] Int. Cl.[3] ..... B65J 1/08; E05F 15/00

[52] U.S. Cl. ..... 49/72; 49/280; 49/349

[58] Field of Search ..... 49/28, 70, 72, 280, 49/30, 349

[56] References Cited

U.S. PATENT DOCUMENTS

| | | | |
|---|---|---|---|
| 3,145,988 | 8/1964 | Colautti et al. | 49/280 |
| 3,202,414 | 8/1964 | Simmons et al. | 49/280 |
| 4,381,625 | 5/1983 | Andrei-Alexandru et al. | 48/280 |

*Primary Examiner*—Kenneth Downey

*Attorney, Agent, or Firm*—James B. Raden; William J. Michals

[57] ABSTRACT

A motor driven window regulator combined with a door lock for a motor vehicle. A reversible motor is used to drive a sector gear. The sector gear in turn rotates a gear to pivot a lever to raise and lower the window. An engaging clutch pivoted to the free end of the lever is used to couple and decouple the mechanism to the window.

3 Claims, 4 Drawing Figures

WINDOW LIFTER AND DOOR LOCKING DEVICE

BACKGROUND OF THE INVENTION

This invention starts from an adjusting device, especially from a combined window lifter and central door locking installation in motor vehicles, comprising a reversible electric motor and a mechanism which transmits a movement of the electric motor and which, between two end positions, is adjustable by the electric motor into two oppposed directions.

Such an installation is known from the German laid open print No. 28 54 713. In addition to some embodiments in which the mechanism is adjusted in the one direction by an electric motor and in the other direction by a spring element which has been prestressed during the previous movement this specification also shows an embodiment in which the movement of the electric motor in the one direction and in the other direction is the direct cause for a displacement of the mechanism. For this purpose a rod of the mechanism is suspended in a sheet metal part on which the electric motor is mounted and, when the window pane also adjustable by the motor is blocked, the sheet metal part is swivelled together with the electric motor. Both in the first mentioned embodiments and in the last one the mechanism, which transmits a movement of the electric motor to the lock of the door, cannot be manually adjusted from one stable end position into the other. When the mechanism is directly coupled with the electric motor in both adjusting directions any attempt of a manual displacement is blocked by the fact that the electric motor is self-locking. When, on the other hand, the mechanism is moved in the one direction by the electric motor and in the other direction by a prestressed spring element a manual displacement in the direction in which, normally, the electric motor is active would immediately be followed by a resetting through the spring element when the external force is no longer applied. In this case the vehicle could eventually be manually locked in a complicated way in that the locking button, which is part of the door locking installation, in its depressed position normally corresponding to a locked vehicle door, is once again locked by additional measures. This is rather complicated and, moreover, also unreliable, because a supposedly locked door can still be unlocked, if one forgot to lock the button additionally. Furthermore a vehicle door can only be manually unlocked, if it was manually locked before. If it were locked by the electric motor a manual unlocking is blocked by the self-locking electric motor.

The German laid open print No. 28 07 673 shows several adjusting devices including a mechanism which is adjustable by an electric motor between two end positions and transmits a movement of the electric motor to the lock of a vehicle door. The mechanism is fitted with a device which permits manually to adjust parts of the electric motor, when the electric motor is at standstill. Thereby the electric motor of the adjusting devices always rotates in the same direction. Thus the devices for manual displacement are designed in such a way that they can predominantly be used with such electric motors and cannot be used with reversible electric motors.

It is the objective of the invention to develop an adjusting device including the features of the present invention in such a way that due to its design it can be operated more easily. Above all it has to be possible also manually to adjust the adjusting element on which the mechanism transmits the movement of the electric motor. This is to be achieved in a manner as simple as possible and without disturbing the other functions of the adjusting device.

SUMMARY OF THE INVENTION

This problem is solved according to the invention fór an adjusting device including the features of the invention in that a disengaging and engaging clutch including an input element and an output element is fitted in the mechanism and that, seen from the electric motor, the parts of the mechanism positioned behind the input element are also manually adjustable into both directions. By this invention it is thus made possible that also with a reversible electric motor, whose output does not execute an entire rotation during an adjustment operation, it is possible manually to adjust the adjusting element onto which the mechanism transmits the movement of the electric motor. When this refers to the locking of a vehicle door, this means for example that this particular door can be manually locked or unlocked via the actuating button on the vehicle door. The door can also be locked or unlocked, when the electric motor fails.

Advantageous developments of the invention can be seen from the subclaims. In the developments according to other features the clutch is non-positive. This involves the advantage that it can be disengaged and engaged in any intermediate position between the two end positions of the mechanism also when the design is most simple. A friction or sliding clutch must be developed in such a way that, when it is operated by an electric motor, the force can be transmitted through it which is necessary for adjusting the mechanism and the adjusting element. On the other hand the frictional connection must be so small that a manual displacement without application of too big a force is ensured. A compromise must be found for these two opposed secondary conditions.

In order to achieve that in addition to a reliable displacement by the electric motor also a manual displacement with a small amount of force is possible, it is reasonable that the coupling members are in gear transversally to the adjusting direction and that after the output element has been blocked in the adjusting direction the clutch may be disengaged by a further movement of the electric motor. Thereby the output element is blocked in the one direction in the one end position and in the other direction in the other end position. After the output element has entered the end position the electric motor continues to move somewhat and thereby disengages the clutch. Thereafter the parts of the mechanism which are positioned behind the input element can be easily manually adjusted. According to another feature the clutch may be engaged and disengaged in each end position of the output element. This involves the advantage that the manual displacement and the motor-driven displacement are completely independent of each other. If for instance the clutch might be disengaged only in one end position, a manual displacement from the one end position would only be possible, if a manual displacement into this position had been effected. According to another feature the clutch may be disengaged by a movement of the output element also in each intermediate position, when the input element is blocked. Such a design permits to adjust the mechanism manually, if the electric motor suddenly failed during a motor-driven adjusting operation and the mechanism thus were positioned in an intermediate position.

The clutch can be disengaged in a simple manner according to another embodiment in that the one element is flexibly mounted on a bearing member and that it is swivallable upon the further movement of the electric motor. Thereby the swivelling is controlled advantageously by a stud and a cam which are displaced relative to each other. Thereby it is possible on principle that control stud and control cam are positioned on input and output element, couple the two elements with each other and are only moved relative to each other, when a given force is exceeded. However the output element could not be manually adjusted completely independently of the input element. The friction between the control stud and the control cam would have to be overcome. It is therefore more advantageous, when the control stud or the control cam is at rest relative to the mechanism. In this case input element and output element can be separated from each other completely.

In a development according to another feature the swivallable element is disengaged from the other element with the further movement of the electric motor and is engaged again with a movement into the opposite direction corresponding to the further movement.

Thus the output element is not adjusted immediately, when the electric motor begins to rotate, but only when the clutch is engaged again after a short movement of the electric motor.

According to the advantageous development of another embodiment it is possible in contrast thereto directly to take along the output element in the adjusting direction, when the electric motor starts. This is achieved in that the swivallable element has two portions, that by means of one of these portions it may be coupled with the other element only in the one direction and by means of the other portion with the other element only in the other direction and that in each end position for changing the coupling direction it may be changed over from one stable position to a second stable position by the further movement of the electric motor. According to this version can be developed advantageously in such a way that the other element may be used as a control part for the change-over of the swivellable element. Because the swivallable element can occupy two stable positions, the output element thereby can nevertheless be manually moved completely independently of the input element. In addition a change-over of the swivallable element is also possible in each intermediate position, when the input element of the clutch is blocked in this position. The stable positions of the swivellable element are achieved according to another feature in a simple way in that a snap spring is fitted between the swivellable element and the bearing member and that stops are provided for the swivellable element.

The advantageous development according to the invention provides that the swivellable element is the input element of the clutch. This is why the swivellable element is not taken along by a manual displacement. Under certain circumstances also its control is to be simplified.

The remaining variations mainly refer to embodiments in which the initiating movement for adjusting the mechanism is a swivelling movement of the electric motor. By the embodiments according to other forms of the invention the electric motor is held in the one end position of its swivelling range by a predetermined force. The electric motor of a combined window lifter and central door locking installation occupies this end position, when it moves the window pane.

As a matter of fact the use of a clutch is particularly of advantage, when the electric motor is self-locking. It is, however, even advantageous in cases where the gearing and the armature of the electric motor could be turned upon manual displacement, because this would make a manual displacement more difficult.

Several embodiments of an adjusting device according to the invention are shown in the drawing. The invention will be described below by means of these embodiments which are developed as combined window lifter and central door locking installations.

BRIEF DESCRIPTION OF THE DRAWINGS

The drawings show

DETAILED DESCRIPTION

Figure 1:
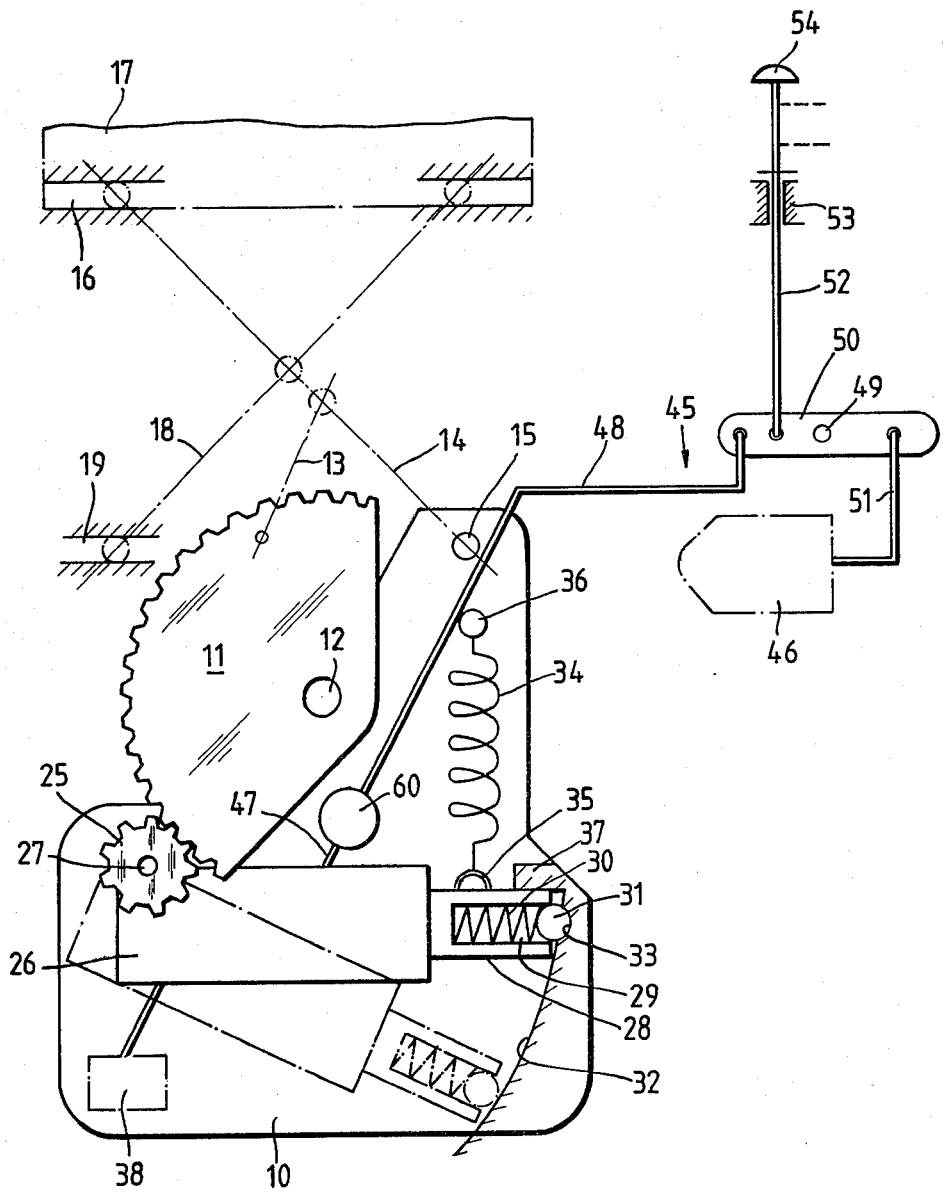
FIG. 1 a combined window lifter and central door locking installation including a clutch in the transmission mechanism between the swivellable electric motor and the door lock, FIG. 2 an embodiment including a sliding clutch, FIG. 3 an embodiment including an input element which is swivellable via a control cam and a control stud and FIG. 4 a last embodiment including a swivellable input element which is able to occupy two stable positions.

The major part of the combined window lifter and central door locking installation according to FIG. 1 is fastened on a supporting plate 10. A toothed quadrant 11 on the axle 12 is rotatably mounted on the supporting plate 10. Via an intermediate rod 13 the toothed quadrant is connected with an adjusting rod 14 which, at its lower end 15, is rotatably held on the supporting plate 10. The other end of the rod 14 is guided in a groove 16 of the window pane 17. To the rod 14 a further adjusting rod 18 is articulated approximately in the middle the upper end of which adjusting rod 18 is also guided in the groove 16 and its lower end is guided in a groove 19 which is at rest relative to the window pane and extends in parallel to the groove 16.

The toothed quadrant 11 mates with the pinion 25 of the electric motor 26. The shaft 27 on which the pinion 25 is seated in a manner protected against twisting can rotate in stationary bearings on the supporting plate 10 or other additional fastening members. On the front side not facing the pinion 25 a stud 28 is fastened on the housing of the electric motor 26 by means of a pocket bore 29 which is open in the direction away from the motor housing. In the bore 29 a locking spring 30 is inserted which presses the locking ball 31 against the locking cam 32. The locking cam 32 is cylindrically curved and the axis of rotation of the pinion 25 forms its centre line. Only in one place the cylindrical curvature of the locking cam 32 is interrupted by a locking depression 33 in which, in the position of the electric motor 26 shown by continuous lines, part of the locking ball is positioned, so that the electric motor 26 is locked in this position. In addition the electric motor 26 is held in this position by a helical spring 34, which is suspended in an eye 35 at the stud 28 and in an opening 36 of the supporting plate 10. In the direction in which the helical spring 34 is effective the movement of the stud 28 is limited by a stop 37.

When the window pane 17 is opened or closed by the electric motor 26, which is controlled in the one or in the other direction of rotation, the toothed quadrant 11 is driven via the pinion 25 in anti-clockwise or in clockwise direction. When the window is blocked, but the electric motor, without being reversed, is continuedly supplied with current instead of the pinion 25 the entire electric motor is swivelled around the shaft 27 against the force of the helical spring in a position which is indicated by dash-dotted lines. Thereby the locking ball 31 leaves the locking depression 33 and slides or rolls along the locking cam 32. In the end position the electric motor 26 actuates a limit switch 38 which separates the electric motor from the voltage source. Because the electric motor 26 is self-locking it retains its position in spite of the helical spring 34 until, with reversed polarities, it is again connected to the electric network.

To the electric motor 26 a mechanism 45 is articulated which transmits the swivelling movement of the electric motor 26 from this motor to a lock 46, which is installed in a vehicle door. Part of this mechanism 45 are a first element 47 on the electric motor 26, a second element 48, a two-armed lever 50 which is swivellable round the shaft 49 and to whose one arm the element 48 is articulated, and a connecting member 51 which is suspended on the other arm of the lever 50 and which leads to the lock 46. In addition a rod 52 penetrating the frame 53 of the door and outside of the frame provided with a button 54 is articulated to that arm of the lever 50 to which the second element 48 is connected.

In order to make it possible that the door can be locked and unlocked manually via this button 54 the mechanism transmitting the movement of the electric motor 26 to the lock 46 is fitted with an engaging and disengaging clutch 60. In the present example this clutch is positioned between the first element 47 and the second element 48. This clutch has the effect that in the case of a manual displacement only the parts 48, 50, 51 and 52 are adjusted, while the electric motor 26 and the first element 47 can retain their respective position.

Figure 2:
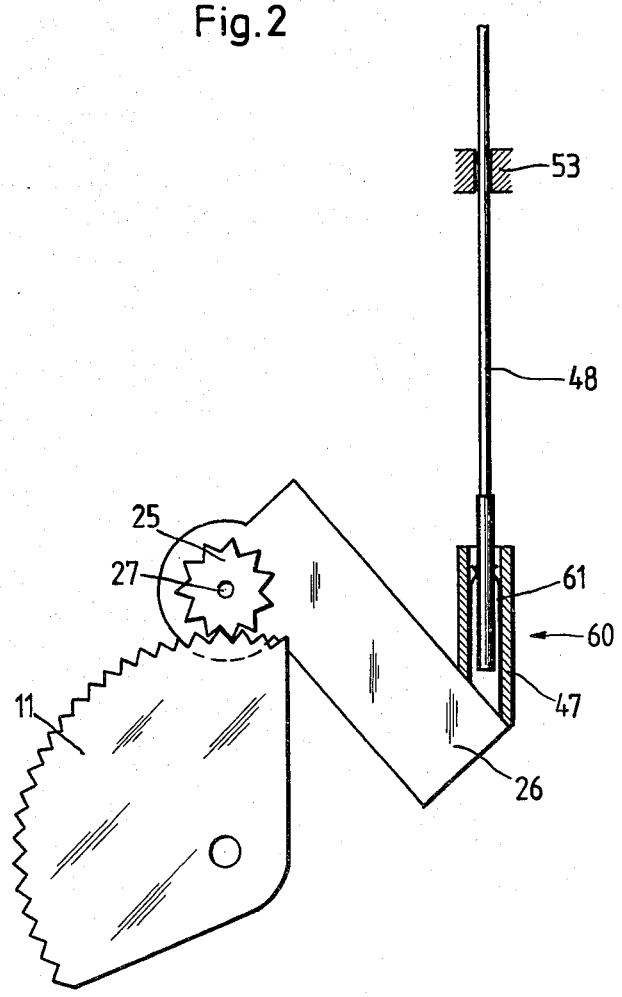
Figure 3:
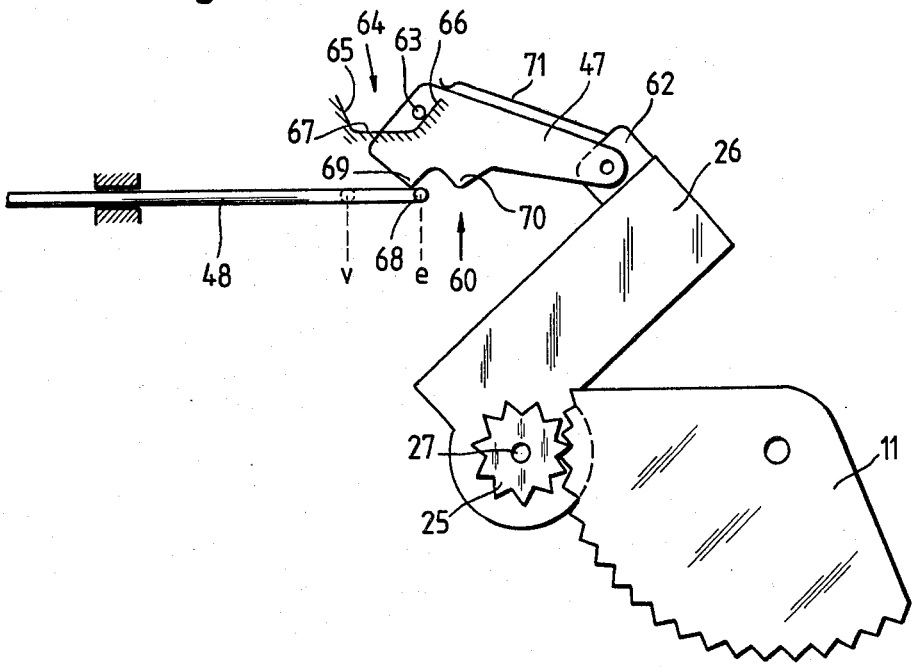
Figure 4:
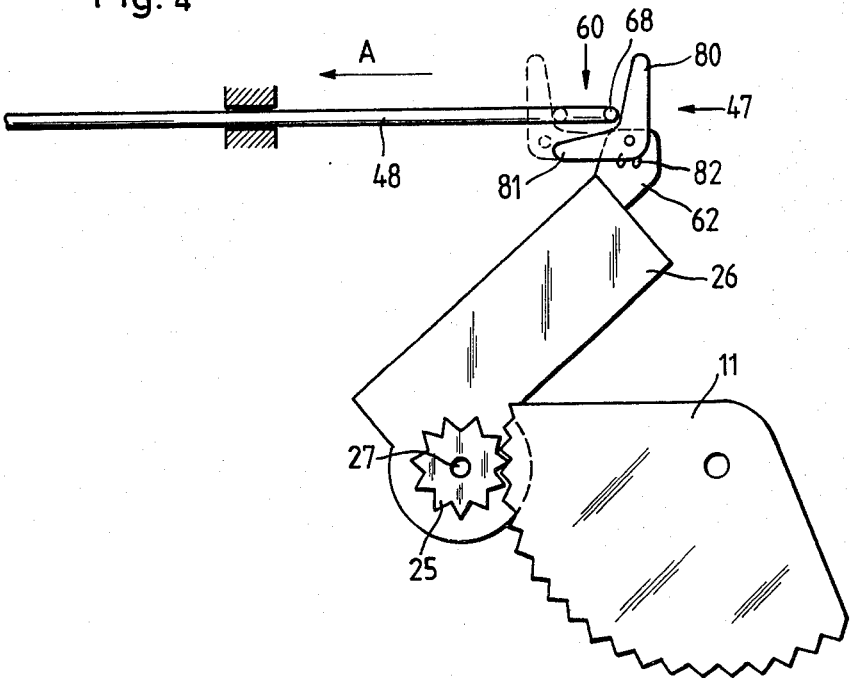

In each of the embodiments according to FIGS. 2 to 4 the clutch 60 is shown in detail. Again the toothed quadrant 11 may be driven by an electric motor 26 via the pinion 25. When the toothed quadrant 11 is blocked in anti-clockwise direction the motor 26 may be swivelled from the position shown in anti-clockwise direction round the shaft 27.

In the embodiment according to FIG. 2 the clutch 60 is developed as a friction clutch and sliding clutch respectively. The rod 48 mounted in the frame 53 of the door has to be regarded as the output element of the clutch and at its end adjacent to the electric motor 26 is lapped over forkedly by the input element 47 of the clutch 60. Two leaf springs 61 are inserted in the fork 47, which leaf springs are fastened on the input element 47 and with their free ends rest upon opposite sides of the output element 47. The springs 61 effect a frictional connection between the input element 47 and the output element 48.

It is assumed that in the position shown of the entire installation the window is closed, thus blocked, and the door is unlocked. If now one wished to lock the door and the electric motor 26 were controlled the latter swivels in anti-clockwise direction and thereby takes along the input element 47. The force necessary for locking the door is smaller than the force which can at most be transmitted from the input element 47 to the output element 48 via the springs 61. Therefore the output element 48 is also moved and the door is locked. In the case of a motor-driven unlocking the motor swivels back to the position shown in the drawing and thereby takes along the output element 48 and the input element 47.

If, in contrast thereto the door were to be locked manually, for example by the button 54 of FIG. 1, the output element 48 of the clutch 60 can be moved against the holding force exerted by the spring 61 without a change in the position of the input element 47. In case of a subsequent manual unlocking the output element 48 is pushed back in the forked input element 47 of the clutch 60. If the electric motor 26 were controlled and failed during a displacement, the output element can also be manually moved to and fro. The coupling between the input element 47 and the output element 48 thus may be engaged and disengaged in any intermediate position between the two end positions which correspond to the completely locked and to the completely unlocked condition of the door.

The same is valid for the embodiment according to FIG. 3. in this version the input element 47 is flexibly mounted on a bearing part 62 which is fastened on the motor housing. Thus the input element 47 represents a lever. The lever has a single arm. On this arm it carries a control stud 63 which co-operates with a control cam 64 fixed to the frame of the door. This control cam is formed like a trough by two diagonal members 65 and 66 rising in opposite directions and a plane portion 67 connecting the feet of the two diagonal members. Below the lever 47 the rod-like output element 48 is arranged which from the end adjacent to the lever 47 is bent rectangularly over a certain distance to form a hook 68. The side of the lever 47 facing the hook 68 is provided with a contour being composed of two triangles 69 and 70 with considerably rounded edges. A spring 71 fastened on the bearing member 62 acts upon the lever 47 in the direction of the control cam 64 and the output element 48.

In the position shown the door is unlocked. The lever is lifted from the output element 48 against the force of the spring 71 by the stud 63 which has moved upwards along the control cam 64. If now, in the case of a motor-driven locking of the door the electric motor were swivelled in anti-clockwise direction, the stud 63 can slide downwards along the diagonal member 66, so that, due to the spring force, the lever is swivelled in anti-clockwise direction and the hook 68 is positioned in the trough between the two triangles 69 and 70. With a further movement the output element 48 is taken along. As soon as the hook has reached the position shown by broken lines the door is locked and the output element 48 is no longer displaceable further. Now the stud 63 on the lever 47 comes to the diagonal member 65 of the control cam 64 and during a further short swivelling movement of the electric motor 26 lifts the lever 47 from the hook 68. As in the position of the lever 47 shown in the drawing the output element 48 can now be freely manually moved to and fro by this lever. In the case of a motor-driven unlocking in contrast thereto the stud slides down the diagonal member 65 of the control cam 64, so that the output element 48 is again coupled with the input element 47 and is adjustable with the electric motor.

If in the embodiment of FIG. 3 the electric motor were blocked in any intermediate position between the two end positions, so that also the input element can no longer be moved in the adjusting direction, so that due to the two inner diagonal surfaces of the contour 69, 70 a decoupling between the input element 47 and the output element 48 is also possible. The two outer diagonal surfaces permit a coupling and an adjusting of the output element 48 over its entire motion range. Then the plane portion 67 of the control cam 64 limits the swivelling range of the lever 47 in anti-clockwise direction, so that the output element 48 always meets the contour 69, 70.

In the embodiment according to FIG. 4 the input element 47 of the clutch 60 is also a lever which is swivallably mounted on a bearing member 62. But now the lever is developed as a two-armed angle lever, whose arms 80 and 81 stand rectangularly on each other. Between the lever 47 and the bearing member 62 a snap-action spring 82 is fitted which together with corresponding stops has the effect that the lever 47 can occupy two stable positions at a spacing of 90° from each other. In the one position, which in FIG. 4 is shown by continuous lines, the arm 80 stands perpendicularly on the longitudinal direction of the output element 48, while the other arm 81 extends in the longitudinal direction of the output element 48. In the other position, which is shown by broken lines, the arm 81 stands perpendicularly, whereas the arm 80 extends in parallel to the output element 48, but in the opposite direction as the arm 81 in the corresponding position. The output element 48 is again bent to form a hook at its end co-operating with the input element 47.

If the piece parts shown in FIG. 4 occupied the positions shown by continuous lines, the window is closed and the door unlocked. For a locking of the door the output element 48 must be displaced in the direction of arrow A. Seen in the opposite direction the arm 80 of the lever 47 lies behind the hook 68 of the output element 48. If now, for locking the door, the electric motor 26 is swivelled in anti-clockwise direction, the arm 80 of the input element 47 immediately takes along the output element via the hook 68. In contrast to the embodiment of FIG. 3 in this case a defined path for engaging the clutch is not necessary. When the hook 68 has reached the end position shown by broken lines the lever 47, by a further movement of the electric motor 26, is swivelled beyond the dead centre of the snap-action spring 82 and then by this spring adjusted to the position shown by broken lines, without the electric motor having to carry out a further movement. Seen in the direction of the arrow A the arm 81 of the lever 47 is now positioned behind the hook 68. In the case of a motor-driven unlocking this hook can be displaced by the arm 81 of the lever 47 in the opposite direction of the arrow A.

Starting from the positions of the piece parts shown in FIG. 4 by continuous lines and assuming that a locking of the door has to be manually effected, the output element 48 can without difficulties be moved in the direction of arrow A, because the arm 80 of the input element 47 is now positioned behind the output element. In the same way the unlocking can be effected manually after a preceding motor-driven locking. Even if the electric motor 26 were blocked in any position between the two end positions it is still possible to adjust the output element 48 manually. It is assumed that the electric motor has moved from the position shown over half of its swivelling angle. The arm 80 of the lever 47 is still located behind the hook 68, so that the output element 48 can be brought into its left-hand end position without difficulties. Then the door is completely locked. If now an unlocking had to take place the output element 48 is manually moved to the right and eventually hits the arm 80 of the lever 47. A further displacement beyond this point has the effect of swivelling the lever 47, so that the arm 80 leaves the path of the hook 68. Now the output element 48 can be displaced into its right-hand end position. In the case of a locking, thus in the case of adjusting the output element 48 to the left the arm 81 of the lever 47 is swivelled from its path. Thus the door can also be locked or unlocked, when the electric motor is blocked in an intermediate position, whereby with each operation the lever 47 is changed over. In contrast thereto it is not necessary to swivel the lever 47, when the electric motor 26 is blocked in one of the end positions.

In addition we wish to point out to the fact that by developing an adjusting device according to the invention at the same time the electric motor is protected against blocking. Now the electric motor can still reach its end position, actuate a position switch there and thus interrupt the connection to its electric network, if any part of the mechanism which, seen from the motor, were positioned behind the input element of the clutch 60 or any part in the lock of the door were blocked against a displacement. A destruction of the electric motor by exceeded current consumption and thus generation of heat can be avoided.

Though the embodiments shown only include combined window lifter and door locking installations, it can easiliy be understood that the adjusting device according to the invention is also of advantage, if it were only used for the central locking and unlocking of doors.

What is claimed is:

1. A combination power window and power door locking device for use in an automotive vehicle door comprising, in combination:

a reversible electric motor;

means for mounting said motor internally of said door;

first means for coupling said motor to a movable window pane holder within said door to move said holder between first and second end positions;

second means for coupling said motor to a movable extension of a door locking mechanism within said door which is activated to lock and unlock said door;

means for selectively applying external power to said motor;

means cooperating with said first and second means and responsive to the position of said holder for engaging and activating said door locking mechanism when said holder is in one of its end positions;

wherein said motor is rotatably mounted in said door and resiliently urged toward an angular stop position until said holder is in said one of its end positions whereupon continued application of said external power to said motor rotates said motor away from said stop position to activate said door locking mechanism;

wherein said second means includes:

an input element connected to said motor, an output element connected to said extension of said door locking mechanism and a disengaging clutch connecting said input element to said output element; and, wherein said door locking mechanism includes an actuating member connected to said output element for manually locking and unlocking said door when a predetermined force is applied to said actuating member; and wherein said disengaging clutch disconnects said output element from said input element when the force transmitted through said disengaging exceeds said predetermined force.

2. The combination according to claim 1, wherein said disengaging clutch comprising a sliding friction clutch.

3. The combination according to claim 1, wherein said disengaging clutch comprises a lever which is resiliently urged against a cam surface.

* * * * *